US005715636A

United States Patent [19]

Taylor

[11] Patent Number: 5,715,636

[45] Date of Patent: Feb. 10, 1998

[54] LIGHT TRANSMITTING ROOF/FLOOR SYSTEM

[75] Inventor: John R. Taylor, Irving, Tex.

[73] Assignee: Innovative Building Products, Inc., Fort Worth, Tex.

[21] Appl. No.: 559,770

[22] Filed: Nov. 15, 1995

[51] Int. Cl.[6] ..... E04B 5/46; E04C 1/42

[52] U.S. Cl. ..... 52/308; 52/200; 52/656.2; 428/428; 428/437

[58] Field of Search ..... 52/200, 235, 307, 52/308, 384, 387, 656.2; 428/426, 428, 437

[56] References Cited

U.S. PATENT DOCUMENTS

| | | | |
|---|---|---|---|
| 1,667,484 | 4/1928 | Liese . | |
| 1,940,968 | 12/1933 | Ohlis | 189/76 |
| 1,946,977 | 2/1934 | Lenke | 94/27 |
| 1,987,490 | 1/1935 | Mulford | 94/27 |
| 2,182,971 | 12/1939 | Richards | 94/28 |
| 2,198,450 | 4/1940 | Chertkof | 108/16 |
| 2,199,244 | 4/1940 | Mulford | 108/16 |
| 2,655,881 | 10/1953 | Lenke | 108/16 |
| 4,455,798 | 6/1984 | Tsakiris | 52/200 |
| 4,494,342 | 1/1985 | Decker | 52/786.1 X |
| 4,638,613 | 1/1987 | Tönsmann | 52/235 |
| 4,924,649 | 5/1990 | Taylor | 52/656 |
| 4,999,964 | 3/1991 | Taylor | 52/477 |
| 5,003,744 | 4/1991 | Taylor | 52/308 |
| 5,042,210 | 8/1991 | Taylor | 52/307 |
| 5,071,692 | 12/1991 | Jourdaine | 428/426 X |
| 5,145,744 | 9/1992 | Cartier et al. | 428/437 X |
| 5,216,855 | 6/1993 | Richter et al. | 52/200 |
| 5,218,806 | 6/1993 | Taylor | 52/410 |
| 5,352,528 | 10/1994 | L'Her et al. | 428/441 X |
| 5,356,675 | 10/1994 | Unger et al. | 52/786.1 X |
| 5,462,805 | 10/1995 | Sakamoto et al. | 428/426 X |
| 5,496,621 | 3/1996 | Makita et al. | 428/437 X |
| 5,544,455 | 8/1996 | DeBlock | 52/200 |

*Primary Examiner*—Carl D. Friedman
*Assistant Examiner*—Yvonne Horton-Richardson
*Attorney, Agent, or Firm*—Akin, Gump, Strauss, Hauer & Feld, L.L.P.

[57] ABSTRACT

A light transmitting roof, skylight or interior floor/ceiling includes plural panels each having a light transmitting plate assembly formed of a glass plate laminated to a plastic plate having a lower thermal conductivity or a glass plate supported on a grid of glass blocks. The glass and plastic plates are secured together by a silicone adhesive disposed in a peripheral ledge or channel formed in one of the plate members. A perimeter frame is secured to the plate assembly, is inset from the side edges of the plate assembly and may include a grid of divider members for aesthetic and light transmitting purposes or for supporting the glass blocks. The perimeter frame is secured to the laminated plate assembly by angle members and the frame is secured to a substructure such as a grid of beams by respective angle members. Alternatively, the frame supports the glass blocks, rests on the beam grid and the glass plate has a depending perimeter guide member which locates the glass plate with respect to the frame and a thermal barrier member disposed around the periphery of the frame. The panels are disposed directly adjacent to each other and in sealing engagement by peripheral resilient seals.

32 Claims, 7 Drawing Sheets

34
35
32
35
66
36
38
54a
54
54b
54c
54
42
54
40
44
54
50
56
48
50
56
46
52
58
56
56
19
19
19
16d
19
18
18d
16a
18a
16c
18c
16
18
16
16b
18b 80
106b
106e
106
106c
108
106d
106f
106a
102
102c
102b
102a
112
110
88
98
100
19
86
113
90
82
96
84
10
16d
18
16a
16c
18d
16
16b

LIGHT TRANSMITTING ROOF/FLOOR SYSTEM

FIELD OF THE INVENTION

The present invention pertains to a floor, roof or skylight system comprising a grid of light-transmitting panels, each adapted to be disposed on a grid of support beams or joists.

BACKGROUND OF THE INVENTION

There are many architectural applications where a structural member, such as a floor or roof, is desired to be light-transmitting. My U.S. Pat. Nos. 4,999,964 and 5,042,210 are directed to floor, wall and skylight systems which utilize light-transmitting members such as so-called glass "blocks". Glass blocks are widely used in residential and commercial buildings and are commonly clustered in a panel in various and often distinctive geometric patterns. Glass blocks are commercially available in both solid and hollow core configurations, but the use of glass blocks in floor or roof structures has been limited in exterior/interior barrier applications due to the high thermal conductivity of the glass blocks and the resulting condensation of water vapor on the interior facing surfaces of the blocks. Hollow core glass blocks are generally not suitable for floor or roof structures due to their lack of load-bearing capability.

Another factor that has limited the use of glass blocks in roof structures pertains to the large number of blocks required per unit area and the accompanying sealing problems resulting from the increased number of structural units requiring a weather tight seal and problems caused by thermal expansion and contraction of the blocks.

Accordingly, there has been a strongly-felt need to develop a light-transmitting or "glass" floor, roof or skylight structure, particularly adapted for use as a barrier between the out-of-doors and the building interior, which has suitable load-bearing capability as a floor or roof structure, which is substantially transparent, has low thermal conductivity thereby minimizing heating or cooling losses and condensation on the interior surfaces of the floor, ceiling or roof and which has reduced chance of leakage when used as an exterior roof or skylight structure. It is to these ends that the present invention has been developed.

SUMMARY OF THE INVENTION

The present invention provides a unique architectural assembly which utilizes a grid of light-transmitting panels, each panel including means for supporting the panel on a joist or rafter grid.

In accordance with one aspect of the present invention a unique light-transmitting panel is provided for use as a structural member for floors, ceilings, roofs, skylights, walls and similar applications in residential or commercial buildings, which is of a load-bearing capability sufficient to permit its use as a floor or roof member, is sufficiently large to minimize the chance of air and water leakage when used as a roof or skylight member and is of relatively low thermal conductivity to minimize condensation of water vapor on the interior surfaces thereof. The panel is preferably characterized by a laminated plate assembly having a transparent glass outer plate and a transparent inner plate or substrate. The plate assembly may be supported by a unique inset perimeter frame adapted to be supported by a rafter or joist grid system.

In accordance with another aspect of the invention, the panels are each characterized by a generally rectangular light-transmitting laminated plate assembly having an outer or top layer of glass disposed on a substrate formed of a load-bearing, low thermal conductivity light-transmitting member such as an acrylic plastic or the like. The laminated plates are supported by a perimeter frame which is attached to the plates and to the joist or rafter grid by a unique arrangement of connecting members. The perimeter frame may also include a grid made up of load-transmitting and light-reflecting members to aid in supporting the plate assembly and to enhance the aesthetic and light-transmitting effect of the panels.

In accordance with yet another aspect of the present invention, the panels are characterized by a generally rectangular light transmitting plate member which overlies a generally rectangular grid of light transmitting glass blocks supported by a frame. The frame is supported on a rafter or joist grid system. Each plate member is provided with a perimeter guide for positioning the plate member above and supported on the glass block grid. The panel is adapted for use as a floor, ceiling, roof, skylight or wall structure, has pedestrian load bearing capability and is uniquely adapted to minimize thermal conductivity.

The present invention provides certain unique advantages heretofore unavailable for structural applications where it is desired to have a load-bearing floor, ceiling or roof structure which is light-transmitting, preferably transparent, and is made up of panels which may be easily put in place and secured to a substructure of floor joists or rafters. The panels are particularly adapted for use as a building exterior/interior barrier and enjoy certain benefits that will be further appreciated by those skilled in the art upon reading the detailed description which follows in conjunction with the drawing.

DESCRIPTION OF A PREFERRED EMBODIMENT

Figure 1:
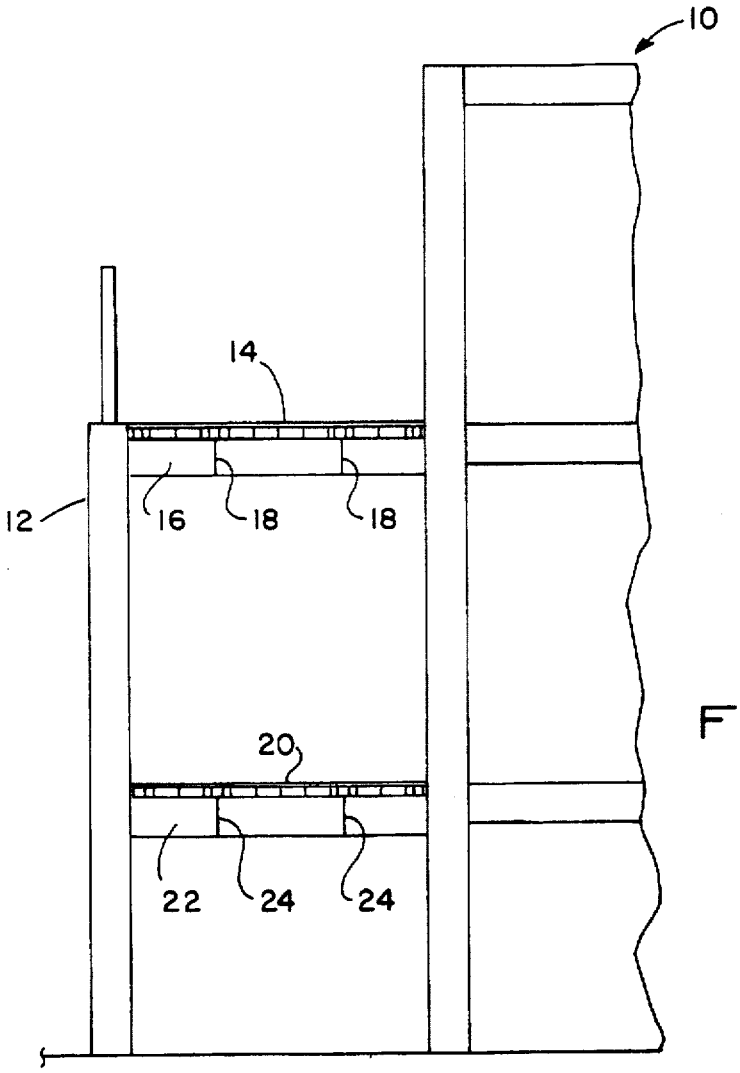
FIG. 1 is a vertical elevation, in somewhat schematic form, of a portion of a multi-story building utilizing a light-transmitted floor and roof assembly in accordance with the present invention.

In the description which follows like parts are marked throughout the specification and drawing with the same reference numerals, respectively. The drawing figures are not necessarily to scale in the interest of clarity and conciseness.

Referring to FIG. 1, there is shown, in somewhat schematic form, a multi-story building 10 having a wing 12 with a generally flat roof section 14 defined in part by a rafter grid including longitudinal beams or rafters 16 and transverse beams or rafters 18. The roof section 14 may also comprise a pedestrian walkway, observation deck, running track or the like. By way of example, the building 10 may also have an interior floor/ceiling structure 20 formed by joists 22 and 24 having essentially the same grid pattern as the rafters 16 and 18. The roof section 14 as well as the floor/ceiling 20 may be constructed in accordance with the present invention.

Figure 2:
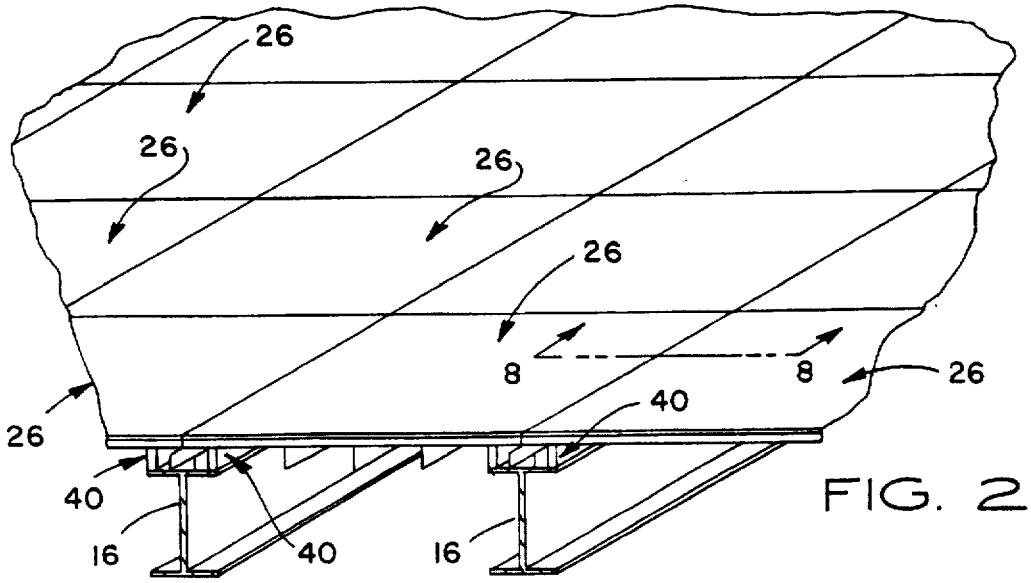
FIG. 2 is a perspective view showing a portion of the roof assembly of the building shown in FIG. 1.

For example, as shown in FIGS. 1 and 2, the roof section 14 is made up of a plurality of unique light transmitting panels 26, in accordance with the present invention, which are transparent or translucent and are supported by the beams 16 and 18. It will be understood that the floor/ceiling 20 on the interior of the building 10 may also be constructed, if desired, in substantially the same manner, and utilizing the panels 26. However, for sake of discussion herein, portions of the following detailed description will refer to the roof section 14 made up of the panels 26 supported on the grid of beams or rafters 16 and 18. The panels 26 are particularly adapted for being disposed as a roof, skylight or exterior wall structure forming a barrier between the exterior of the building 10 and an interior, air-conditioned space 11, for example.

Figure 5:
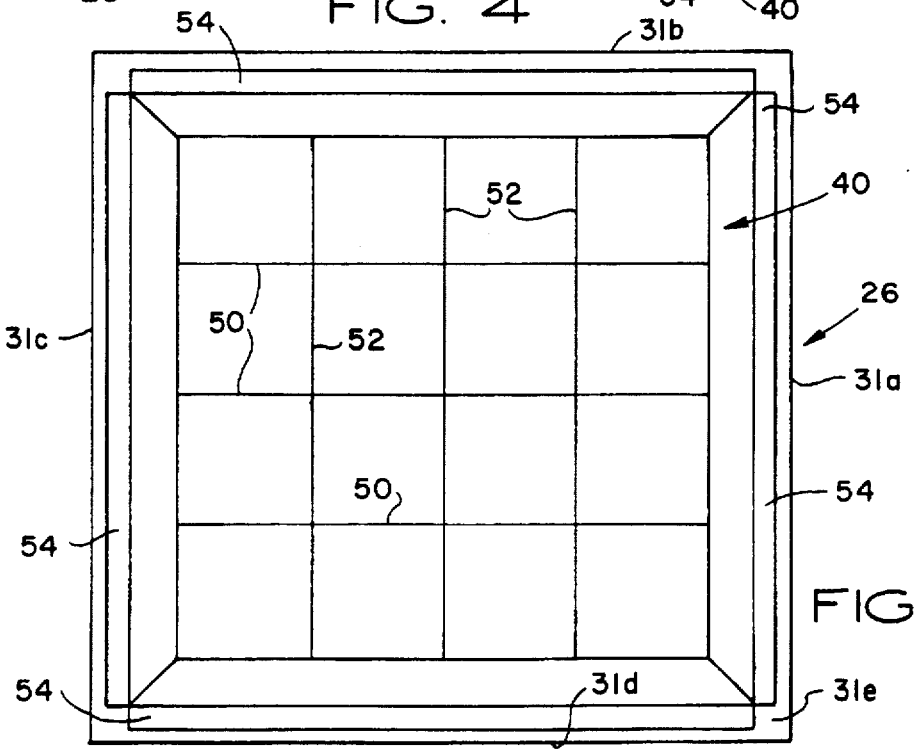
FIG. 5 is a bottom plan view of the panel shown in FIG. 3.
Figure 6:
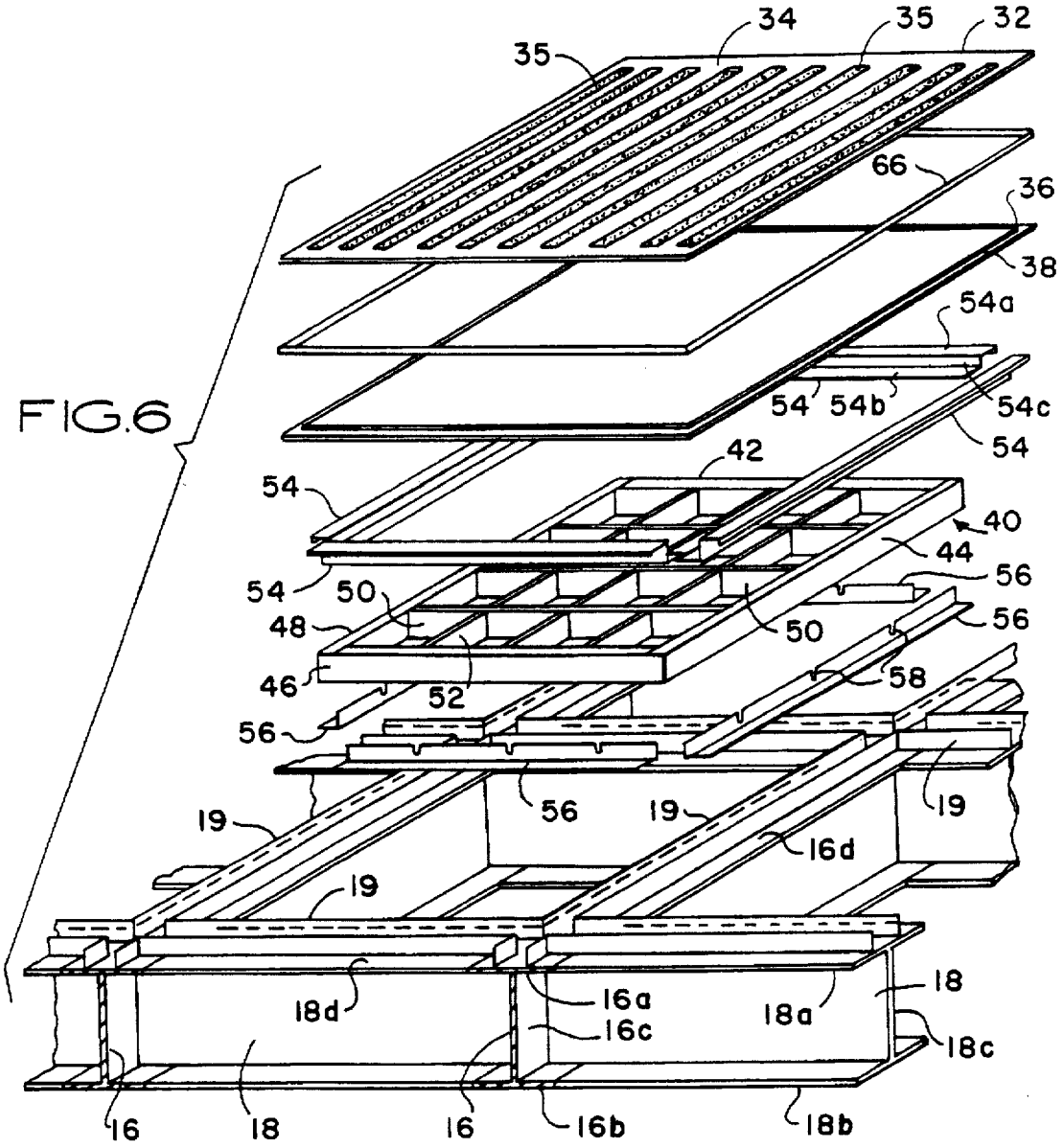
FIG. 6 is a perspective view of a portion of a floor joist or roof rafter grid showing one of the light-transmitting panels partially disassembled.

Referring now to FIG. 6, a portion of the roof rafter grid formed by the beams 16 and 18 is illustrated wherein the beams 16 and 18 are shown as having an I beam-type cross section configuration The beams 16 have opposed flanges **16*a* and 16*b* and a connecting web 16*c*. In like manner, the beams 18 have opposed flanges 18*a* and 18*b* and a connecting web 18*c*. Other beam cross-sectional configurations may be utilized as long as a generally flat or planar upper surface 16*d*, 18*d* is provided to form a generally rectangular or square perimeter surface for supporting the panels 26, respectively. Although a rectangular or square grid system is preferred for supporting the panels 26, the panels may also be supported between elongated parallel beams, such as either the beams 16 or 18, without the transverse connections provided by the grid system shown. Referring further to FIG. 6, and also FIGS. 3 through 5, each of the panels 26 is made up of a laminated plate assembly 31, FIGS. 3 through 5, having a rectangular, preferably square, shape with peripheral opposed sides 31*a*, 31*b*, 31*c* and 31*d*. The plate assembly 31 includes a top or outer member plate 32 formed of a suitable light-transmitting material, preferably a high strength abrasion-resistant glass. The "floor" or exterior surface 34 of the plate 32 may be suitably etched at 35, FIG. 6, to provide a stripe pattern anti-skid surface texture, or otherwise have a suitable coating placed thereon, for example, to provide such anti-skid surface. The plate assembly 31 also includes a second rectangular plate member 36 which is suitably secured to the plate member 32 in a manner to be described herein and which aids substantially in forming a load bearing structure and a thermal barrier between the plate member 32 and an interior air conditioned space, such as the space 11 in the building 10**.

The plate member 36 is preferably formed with an inset or ledge 38, around the periphery thereof for a purpose to be described hereinbelow. The plate member 38 is also formed of a transparent or translucent material such as a high strength acrylic plastic. For use as a floor or roof structure, the plates 32 and 36 are preferably of about 0.50 inches and 1.0 inches thick, respectively. The floor or roof plate assembly 31 may be made up of the laminated plate members 32 and 36 and fabricated as approximately 1.0 meter or 4.0 foot square sections.

Figure 3:
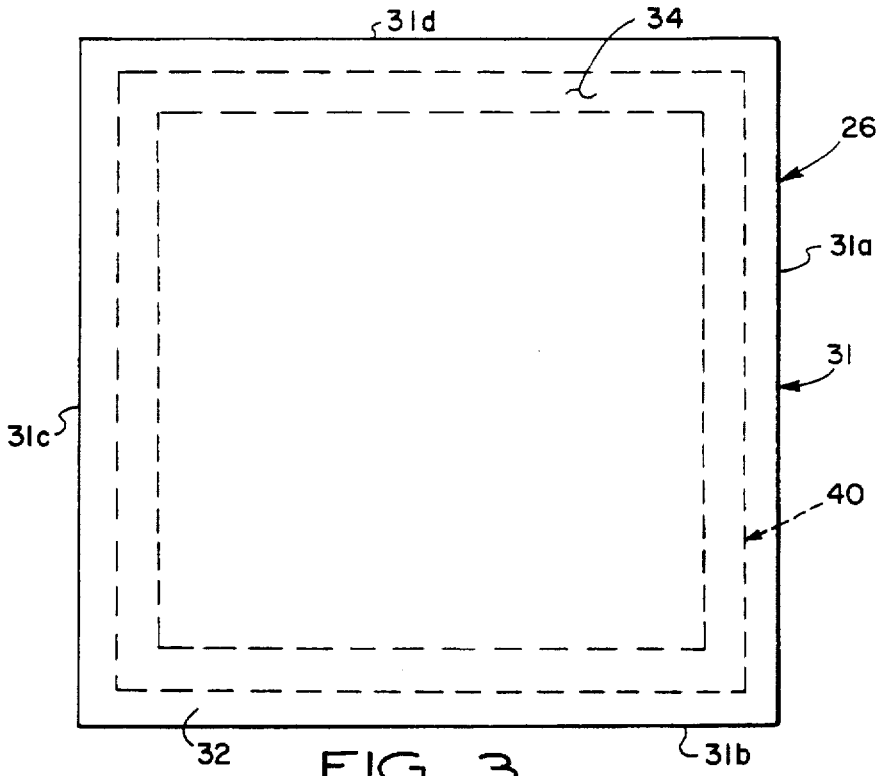
FIG. 3 is a top plan view of one of the panels of the present invention.
Figure 4:
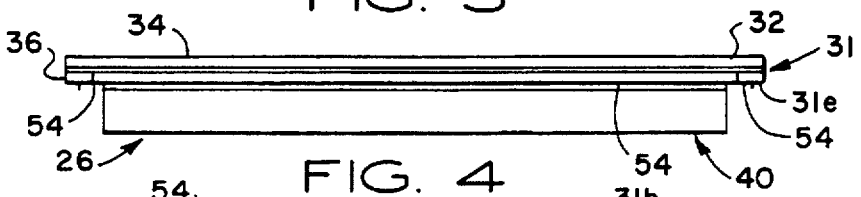
FIG. 4 is a side elevation of the panel shown in FIG. 3.

Referring further to FIG. 6, the panel 26 is also characterized by a support frame 40 of generally rectangular or square configuration and made up of perimeter members 42, 44, 46 and 48. The cross-sectional configuration of the members 42, 44, 46 and 48 may be identical and may be of a type to be described herein. The frame 40 may also include an interior grid formed of intersecting, generally planar divider members 50 and 52, respectively, having the same depth as the frame 40. The members 50 extend parallel to each other, equally spaced apart, between the frame members 44 and 48 and the members 52 extend parallel to each other, equally spaced apart, between the frame and members 42 and 46. As shown in FIGS. 3 through 5, the frame 40 is inset from the side edges **31*a* through 31*d* of the plate assembly 31 to provide a peripheral cantilever portion 31*e* of the plate assembly 31 between each of the side edges 31*a* through 31*d* and the periphery of the frame 40**.

Figure 8:
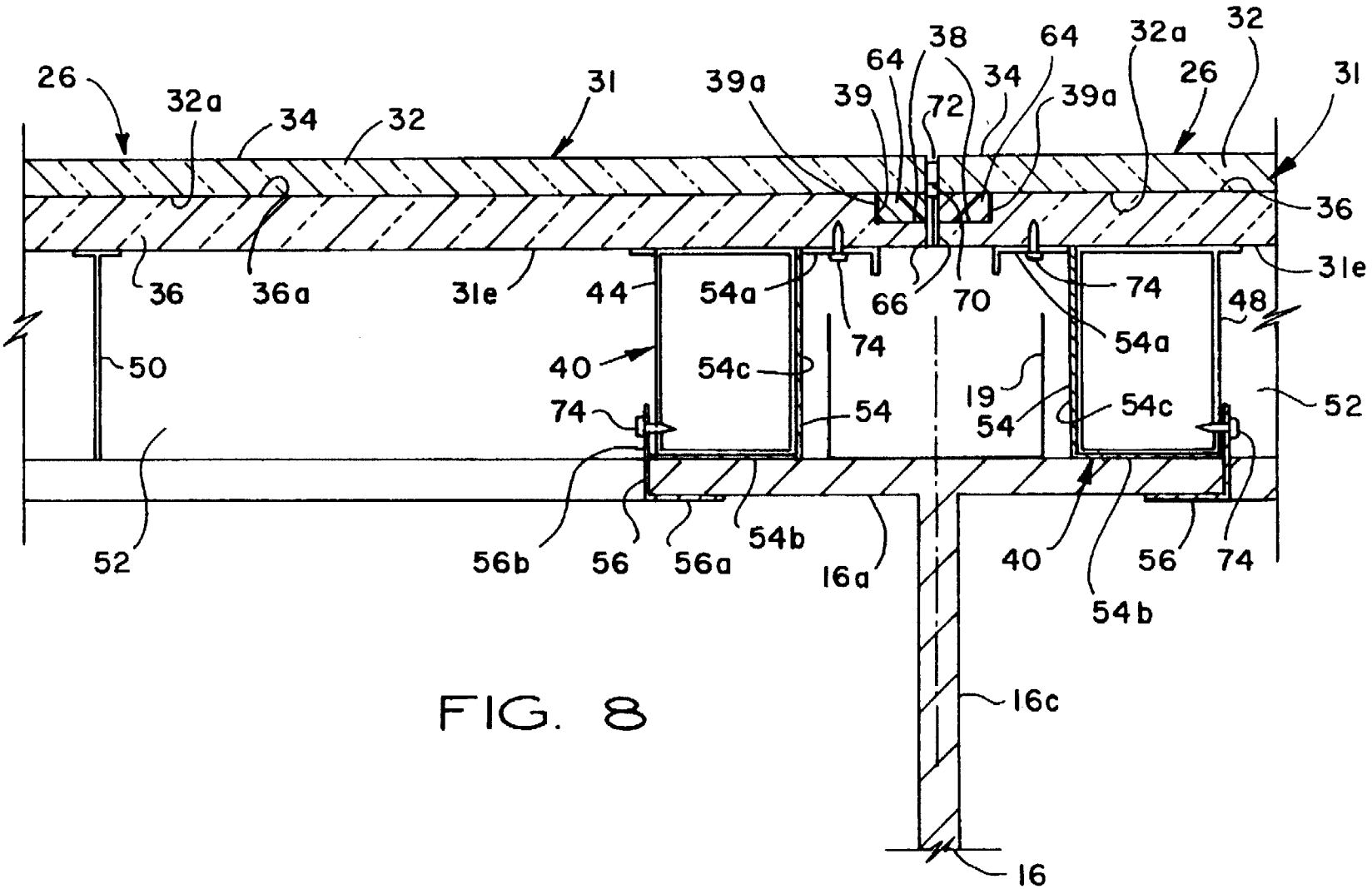
FIG. 8 is a detailed section view taken along the line 8–8 of FIG. 2.

The panel 26 further includes connector members for securing the frame 40 to the plate assembly 31, comprising respective opposed members 54 having a somewhat "S" shaped cross section, see FIG. 8, also. The members 54 each have a first flange **54*a* operable to be connected to plate 36, a second flange 54*b* engaged with frame members 42, 44, 46 or 48, as shown by way of example, in FIG. 8, and a connecting web 54*c*. The members 54 are adapted to be secured to the plate 36 by suitable fastener means to be described further hereinbelow. A panel 26 made up of the laminated plate assembly 31, the frame 40 and the connector members 54 may be secured in a working position between respective pairs of beams 16 and 18 by opposed retainer members 56 which are also formed in cross section as somewhat L-shaped or angle members. Each of the retainer members 56 has appropriately spaced apart slots 58 formed therein to accommodate the grid divider members 50 and 52. The frame 40 is secured to a flange 16*a* or 18*a* of the beams 16 and 18, respectively, by the respective retainer members 56**, also in a manner to be described in further detail herein.

Figure 7:
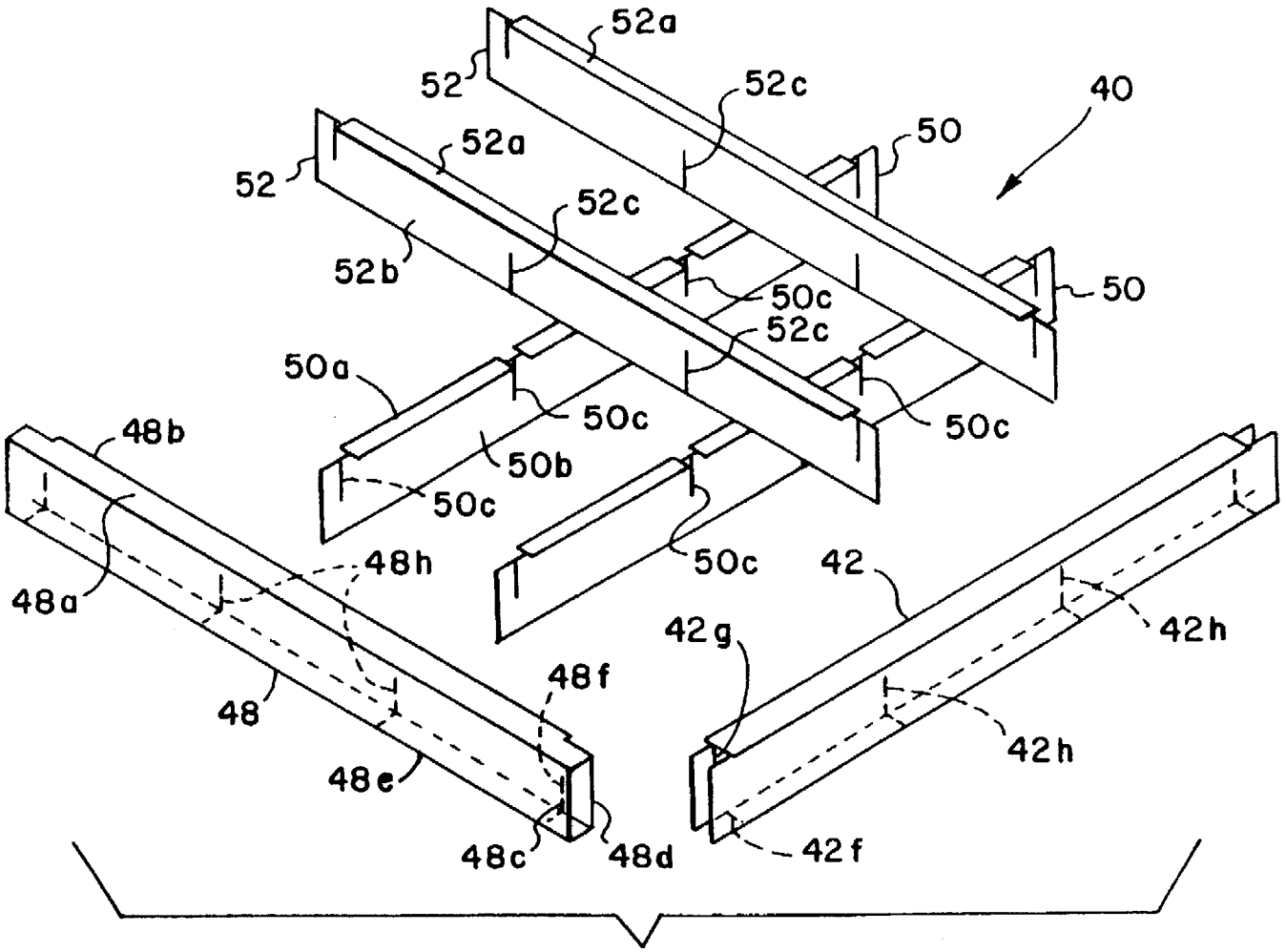
FIG. 7 is an exploded perspective view of a portion of the support frame for the light-transmitting panel of the invention.

Referring now to FIG. 7, a portion of one preferred embodiment of the frame 40, is illustrated. By way of example, portions of two of the perimeter members 48 and 42, are shown. Each of the frame members 42, 44, 46 and 48 is preferably formed of extruded aluminum having a box beam cross section. The member 48 has a top wall **48*a* with a flange extension 48*b*, opposed parallel sidewalls 48*c* and 48*d* and a bottom wall 48*e*. The members 42, 46 and 48 are similarly or identically constructed. At least one of the intersecting frame members, such as a member 42 and 48, is provided with a vertically extending slot, such as the slot 42*f* in FIG. 7, while the member 48 has an L-shaped slot 48*f* formed therein and co-operable with the slot 42*f* and a slot 42*g* to allow the member 48 to nest in the member 42 and interlock with the member at the contiguous ends thereof. Each intersection of a perimeter member of the frame 40** with an adjacent perimeter member is similarly configured to allow the members to be interlocked to each other. U.S. Pat. No. 5,042,210 describes a frame having essentially the same type of connection between the frame perimeter members and the subject matter of that patent is hereby incorporated by reference herein.

As further shown in FIG. 7, the divider plates 50 and 52 are preferably formed as extruded T-section members having generally horizontal top flanges **50*a* and 52*a*, respectively, and depending webs 50*b* and 52*b*. Each of the perimeter frame members 42 and 48, for example, is provided with suitable spaced apart slots 42*h* and 48*h* and each of the divider members is provided with spaced apart slots 50*c* and 52*c* to provide for interlocking the divider members with the frame members and with the divider members extending transversely thereto to provide a somewhat "egg carton" type construction. Accordingly, as shown in FIG. 6, the assembled frame 40 comprises a generally perimeter frame structure formed by the members 42, 44, 46 and 48 and a grid formed by the intersecting divider members 50 and 52. Lastly, the plural members 54, adapted to be engaged with each of the perimeter frame members 42, 44, 46 and 48 along the lower outer sidewalls thereof, respectively, also serve to retain the divider members 50 and 52** in the above-described slots formed in the respective perimeter frame members.

Referring now to FIG. 8, portions of adjacent panels 26 are illustrated showing certain details of the manner in which the plate members 32 and 36 are secured to each other, the plate members 36 are secured to the frames 40 and the frames 40 are secured to the beams 16 and 18; The beams 16 are shown in FIG. 8, by way of example, together with portions of frames 40 for adjacent panels 26, which portions are indicated by the frame members 44 and 48 of the respective adjacent panels. The plate members 32 and 36 are preferably secured to each other by a band of silicon adhesive 64 disposed in the inset or ledge 38 around the periphery of the plate members 36, respectively. The sidewall surface 39 of the ledge 38 which is normal to the surface 34 of plate member 32 is preferably provided with a coating or layer **39*a* of suitable material which will prevent adherence of the silicon adhesive 64 to the surface 39. However, the adhesive 64 will bond to the plate members 32 and 36 otherwise and will secure the plate members together. The seal provided by the adhesive 64 also aids in forming a vacuum on the contiguous planar surfaces 32*a* and 36*a* of the plate members 32 and 36 to also aid in adhering the two plate members together. The silicon adhesive 64 also allows for differential thermal expansion of the plate members 32 and 36, without loss of bond between the plate members due, in part, to the non-adherence of the silicon adhesive to the wall surface 39**.

In the assembled position of the panels 26, shown by way of example in FIG. 8, a peripheral gasket 66 is formed around each plate member 36, see FIG. 6 also. The gasket 66 is preferably formed of a suitable sealant material such as a conventional exterior grade silicone sealant. The gasket 66 may be a continuous piece or may be provided as a tape which is wrapped around the plate assembly 31.

When the panels 26 are placed adjacent to each other, the gaskets 66 are in contiguous, watertight relationship to each other. To further reduce the chance of moisture or air leakage between the panels 26, a peripheral seal member 70 is interposed between the plate assemblies 31 above the gaskets 66, as shown in FIG. 8, and the gap between plates 32 of adjacent panels 26 further filled with silicon adhesive 72, as illustrated. Accordingly, a substantially watertight floor or roof structure may be provided by the seal structure formed between adjacent surfaces of adjacent panels 26. Notwithstanding the substantial watertight seal provided by the above-described construction and the low thermal conductivity of the plate 36, the beam grid provided by the beams 16 and 18 may include suitable guttering 19 interposed between adjacent panels 26, as shown in FIGS. 6 and 8.

Referring further to FIG. 8, the frames 40 are secured to the laminated plate assemblies 31, comprising the plates 32 and 36, by the connector members 54 which are suitably secured to the frame 40 and the plates 36 by self-tapping threaded fasteners 74, for example. In like manner, the divider retainer members 60 are secured to the frames 40 by fasteners 74, also as shown in FIG. 8. Still further, the frame retainer members 56 are secured to the flanges **16*a* and 18*a* by hooking one leg 56*a* of the retainer member under the flange 16*a*, for example, as shown in FIG. 5, and securing the other leg 56*b* to the inner wall of the frame 40, also by suitable fasteners 74**, for example.

Accordingly, the frames 40 may be fabricated from the extruded box beam members 42, 44, 46 and 48 assembled to each other in the manner described above together with the "egg carton" arrangement of the divider members 50 and 52. The divider members 50 and 52 are held in assembly with the frame members 42, 44, 46 and 48 by the members 54 and fasteners 74, also as described above. The frames 40 may also be fabricated by welding suitable perimeter members together to form the generally rectangular perimeter frame described and illustrated. The divider members 50 and 52 may be eliminated, if desired. However, the divider members 50 and 52 provide some structural rigidity for the frames 40, have certain aesthetic appeal and, if formed of a reflective material, such as polished aluminum, for example, aid in reflecting and transmitting light through the panels 26. The frame members 42, 44, 46 and 48 may also be formed of polished aluminum so that each of the spaces defined by the grid within the interior of the perimeter of the frame 40 has substantial light reflecting and transmitting capability. The cantilever portion **31*e* of each panel 26 may be covered with an opaque coating on the underside of plate 36**, if desired.

The laminated plate assembly 31 for each of the panels 26 is assembled by positioning the plates 32 and 36 contiguous and aligned with each other and by applying a layer of adhesive 64 to the routed inset or ledge 38 all around the perimeter of the plate member 36. The coating or tape **39*a* is applied to the surface 39 before applying the adhesive 64 to prevent bonding of the adhesive to that surface. The adhesive 64 is, of course, adhered to the other surfaces of the plates 32 and 36 to bond the plates together, but to also allow for differential thermal expansion between the plates. By providing a plate assembly 31 described above for the panels 26, the panels may be advantageously used as exterior roof or floor members. The low thermal conductivity of the acrylic plate members 36** will minimize heat transfer therethrough and condensation on the plate surface facing the interior building space.

The panels 26 are preferably assembled by connecting the frames 40 to the laminated plates 32 and 36 after the plates have been secured to each other. Pilot fastener receiving openings are preferably formed in each of the members 54, the frame members 42, 44, 46 and 48, the retainer members 56 and the plate member 36 for receiving the fasteners 74.

Panels 26 comprising the laminated plates 32 and 36, together with the frames 40 and gaskets 66 connected thereto, are then mounted on the beam grid comprising the beams 16 and 18 and secured thereto using the retainer members 56 suitably secured in the manner showed in FIG. 8 and described above. The small gaps between adjacent edges of each plate assembly 31 are further sealed with the gasket members 70 and sealant 72.

Those skilled in the art will appreciate that a unique load bearing exterior to interior or interior to interior floor, roof or skylight structure may be provided by assembling plural panels 26, placing the panels on a suitable support structure such as the beam grid formed by the intersecting beams in 16 and 18 and securing the panels thereto in abutting relationship to each other with the seals formed by the gaskets 66, the perimeter rope gasket 70, and the sealant 72 placed in the joint between each panel in the manner shown and described.

Figure 9:
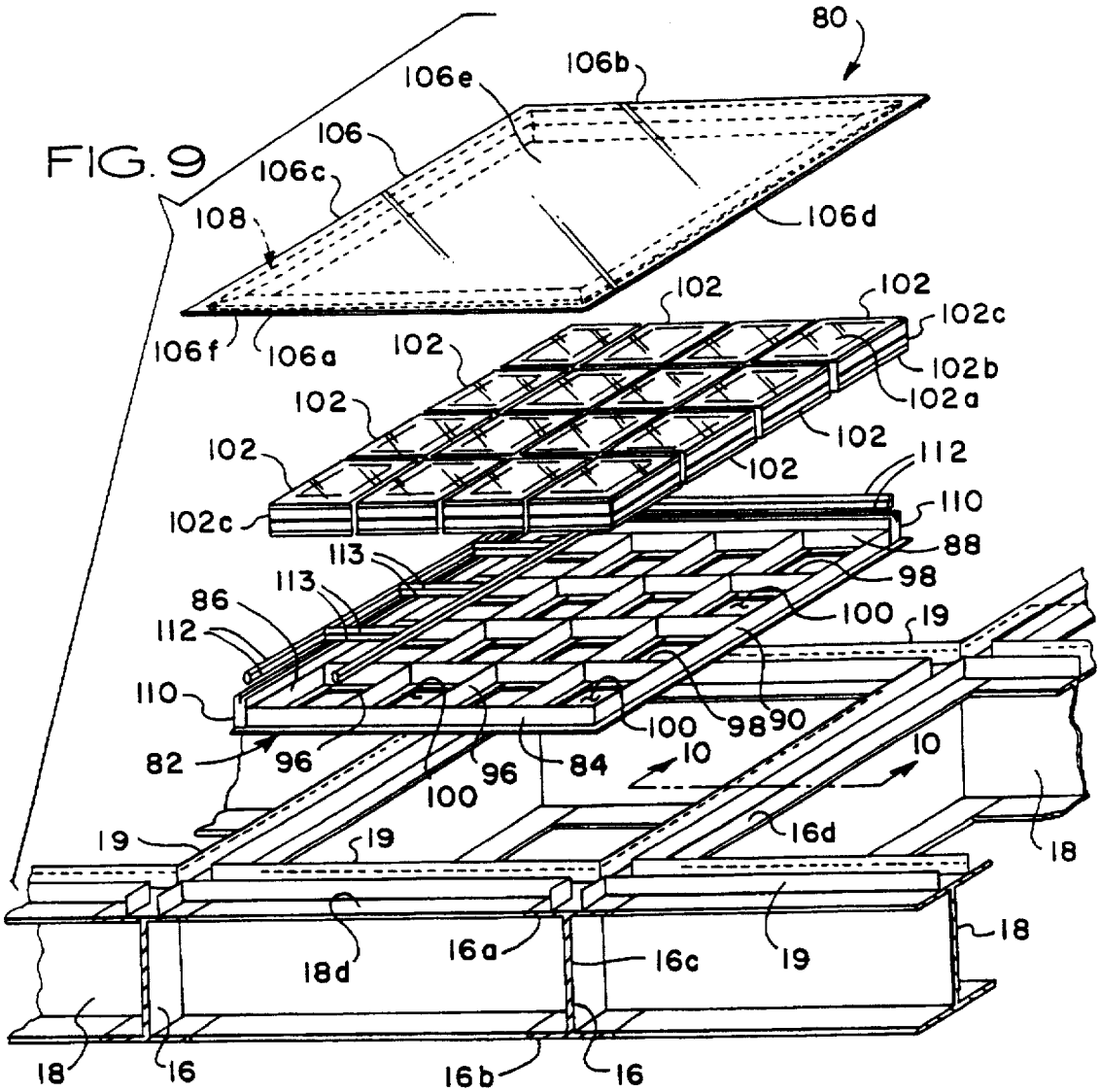
FIG. 9 is an exploded perspective view of the major elements of an alternate embodiment of a panel in accordance with the invention.
Figures 10, 11:
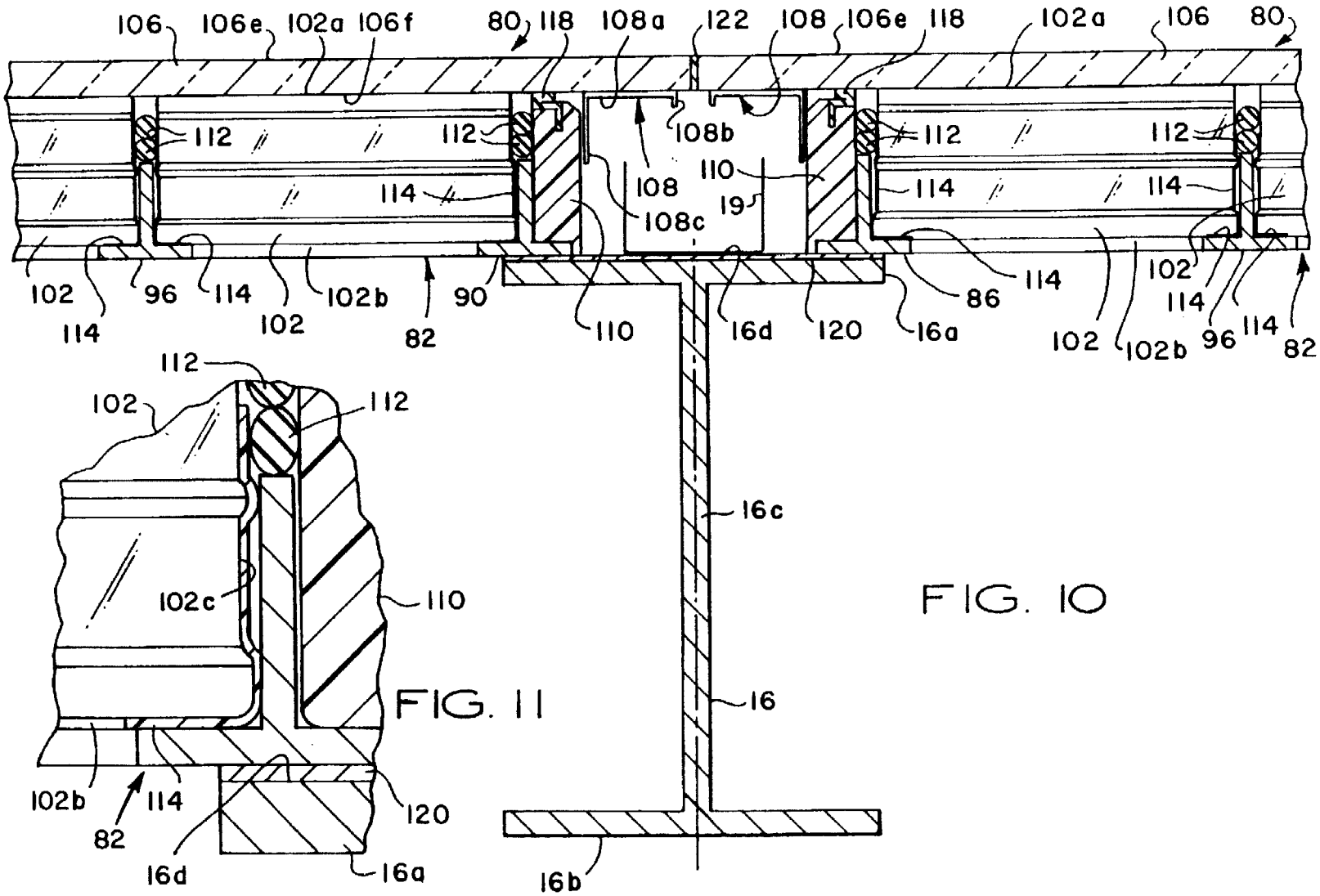
FIG. 10 is a detail section view taken generally from the line 10—10 of FIG. 9 and showing certain details of the structural features of portions of adjacent panels of the embodiment shown in FIG. 9.
FIG. 11 is a detail section view taken in the same plane as the view of FIG. 10 on a larger scale.

Referring now to FIGS. 9 and 10, another embodiment of a load bearing and light transmitting panel is illustrated and generally designated by the numeral 80. The panel 80 comprises a generally rectangular frame 82, preferably made up of inverted T cross section frame members 84, 86, 88 and 90, FIG. 9, each having a transverse bottom flange 92 and an upstanding web 94. A generally rectangular grid is formed between the perimeter members of the frame 82 by intermediate frame members 96 and 98 which are arranged as shown in FIG. 9 in a pattern, equally spaced apart, to form plural receptacles 100, sixteen total, by way of example, for receiving generally rectangular or square glass blocks 102, one in each receptacle. The glass blocks 102 are characterized by opposed top and bottom surfaces 102*a* and 102*b* and an interconnecting exterior sidewall 102*c*. The blocks 102 may be of conventional construction and of a type commercially available. The T cross section frame members 84, 86, 88, 90, 96 and 98 may be formed of structural steel or aluminum of a type commercially available and suitably secured together by conventional welding, for example.

The panels 80 are further characterized by a floor or exterior roof plate member 106 which may be of a square or rectangular configuration, as shown, and has opposed sides 106*a* and 106*b* which are parallel to each other and normal to a second set of opposed sides 106*c* and 106*d*, respectively. Opposed planar surfaces 106*e* and 106*f* further define the plate member 106. The plate member 106 is preferably formed of transparent tempered glass. A one meter square panel may require a thickness of about 0.75 inches for the plate member 106, for example. Each of the plate members 106 has a depending peripheral guide member 108 suitably secured thereto by an adhesive or mechanical fasteners, not shown. As shown in FIG. 10, in particular, the guide 108 is formed by a somewhat inverted channel section having a web 108*a*, a short depending flange 108*b*, forming a moisture drip edge, and a longer depending flange 108*c* extending normal to the plane of the surface 106*f*. The guide 108 extends parallel to each of the sides 106*a*, 106*b*, 106*c* and 106*d* of the plate 106 and is inset from these sides, as shown. The perimeter flange 108*c* formed by the rectangular perimeter guide 108 locates the plate 106 with respect to the remainder of the panel 80, which is defined generally by the frame 82, the glass blocks 102 disposed therein, and a perimeter thermal barrier disposed around the frame and described further herein.

Referring further to FIGS. 9 and 10, each panel 80 also includes the aforementioned thermal barrier comprising plural, substantially rigid barrier members 110 which are disposed contiguous with the web 94 of each frame member 84, 86, 88 and 90 on the outer side of the web opposite the side defining the receptacles 100. The barrier members 110 are coextensive with the length of the webs 94 and are suitably secured to the frame webs 94 by an adhesive, for example. The barrier members 110 are preferably formed of a rigid polymeric material, such as polyvinyl chloride.

The panels 80 further include elongated cylindrical filler or backer rod members which are formed of a flexible closed cell plastic foam, each generally designated by the numeral 112. Each of the rod members 112 is adapted to be interposed between a portion of sidewall 102*c* of a glass block 102 and an adjacent glass block or along the outer surfaces of the outer rows of blocks, between such blocks and the barrier members 110. Short sections of backer rod 113, as shown by example in FIG. 9, are interposed between full length rods 112. As shown in FIGS. 10 and 11, at least two backer rods 112 are disposed contiguous with each other and are dimensioned to be slightly, elastically deformed when the panel 80 is assembled.

As further shown in FIGS. 10 and 11, each of the glass blocks 102 is also preferably nested in its receptacle 100 with its upper surface 102*a* above the webs 94 of the frame members and with a layer of closed cell plastic foam tape 114 interposed between the frame members of the frame 82 and the outer surfaces of the blocks to provide a seal and resilient support for the blocks while allowing for differential thermal expansion between the blocks 102 and the structural steel or aluminum members of the frame 82. Referring further to FIG. 10, the barrier members 110 may be adapted to support a resilient weather strip member 118 around the upwardly facing peripheral surface 110*a* of the barrier members and contiguous with the surface 106*f* of the plate 106.

The panels 80 may be supported on the rafter or joist grid 16, 18 in somewhat the same manner as the panels 26. A plurality of frames 82 may be made up by conventional construction methods, such as welding the members 84, 86, 88, 90, 96 and 98 together, to form the frame assembly shown in FIG. 9. Glass blocks 102 may be placed in each of the receptacles 100 with the thermal expansion member 114 disposed in the manner shown in FIGS. 10 and 11 around each of the blocks. Filler or backer rods 112 and 113 may be interposed between adjacent ones of the glass blocks 102 and between the outside rows of blocks in each panel and the adjacent thermal barrier members 110, respectively. The barrier members 110 may be suitably secured to the outer surfaces of the webs 94 and flanges 92 of each of the frame members. The frames 82 may then be disposed on the rafter or joist grid in engagement with the upwardly facing surfaces 16*d* and 18*d* of the respective flanges of the I beam joists or rafters. If the weather strippings 118 are provided they are disposed in place in suitable slot means formed in the barrier members 110 to assume the position shown by way of example in FIG. 10.

After positioning the frames 82 with their glass blocks 102 assembled thereto in position, as shown, on the beams 16 and 18, the plates 106 are placed on top of the frames 82 supported by the glass blocks 102 so that surfaces 102*a* and 106*f* are contiguous. Each plate 106 is positioned or located on its supportive frame by the guide 108. Each guide 108 is dimensioned to provide for virtually no movement of the plate 106 relative to the frame 82 when positioned as shown in FIG. 10. Prior to placement of the frames 82 on the rafter or joist grid, a thermal barrier member 120, FIGS. 10 and 11, comprising a sheet of suitable elastomeric material, for example, may be laid on the surfaces 16*d* and 18*d* of the beam flanges between the frames 82 and the flanges. After positioning each of the plates 106 as shown in FIG. 10, a layer of silicon adhesive 122 is injected between adjacent side edges of adjacent plates to form a substantially watertight seal between the panels 80.

Accordingly, light transmitting, load bearing panels 80 may be constructed in the manner illustrated in FIGS. 9 through 11 and as described above and which enjoy substantially all of the advantages of the embodiment of the invention described in conjunction with FIG. 1 through 8.

Although preferred embodiments of a light transmitting roof, floor/ceiling or skylight panel and system have been described in detail herein, those skilled in the art will recognize that various substitutions and modifications may be made to the panels and the overall systems without departing from the scope and spirit of the invention recited in the appended claims.

What is claimed is:

1. A panel for use as one of a building exterior wall, roof, floor and skylight, comprising:

a generally planar first plate member of light-transmitting material forming an outer surface of said panel;

a second plate member formed of a light-transmitting material having a thermal conductivity less than said first plate member, said second plate member being contiguous with a major portion of said first plate and disposed in supportive relationship to said first plate member; and a support frame for support said first plate member and said second plate member on a structural member of a building to form said one of said wall, roof, floor and skylight, said frame comprising a rectangular perimeter member inset from opposite side edges of said first plate member and secured to said second plate member by connector members disposed along at least two sides of said frame, and said frame includes a generally rectangular grid of divider members extending between opposite sides of said perimeter member.

2. A panel for use as one of a building exterior wall, roof, floor and skylight, comprising:

a generally planar first plate member formed of light-transmitting glass forming an outer surface of said panel;

a second member comprising a plate formed of a light-transmitting material having a thermal conductivity less than said first plate member and disposed in supportive relationship to said first plate member;

adhesive means for securing said first plate member to said second member;

one of said first plate member and said second member including a peripheral inset forming a ledge for receiving said adhesive means for bonding said first plate member to said second member; and a support frame for supporting said first plate member and said second member on a structural member of a building to form said one of said wall, roof, floor and skylight.

3. The panel set forth in claim 2 wherein:

a surface forming a boundary of said 1edge is provided with means to prevent adhesive from bonding to said surface.

4. A panel for use as one of a building exterior wall, roof, floor and skylight, comprising:

a generally planar first plate member of light-transmitting material forming an outer surface of said panel;

a second member formed of a light-transmitting material and disposed in supportive relationship to said first plate member;

a support frame for supporting said first plate member and said second member on a structural member of a building to form said one of said wall, roof, floor and skylight; and plural retainer members for securing said frame to spaced apart beams forming a support for plural ones of said panels.

5. A panel for use as one of a building exterior wall, roof, floor and skylight, comprising:

a generally planar first plate member of light-transmitting material forming an outer surface of said panel;

a second member formed of a light-transmitting material and disposed in supportive relationship to said first plate member;

a support frame for supporting said first plate member and said second member on a structural member of a building to form said one of said wall, roof, floor and skylight, said frame including means for providing a plurality of receptacles; and said second member comprising a plurality of glass blocks disposed in said receptacles, respectively.

6. The panel set forth in claim 5 including:

a thermal barrier member disposed around the perimeter of said frame.

7. The panel set forth in claim 6 including:

resilient gasket means interposed between said first plate member and said barrier member.

8. The panel set forth in claim 5 including:

resilient filler means interposed between adjacent ones of said glass blocks and between said glass blocks and said frame.

9. The panel set forth in claim 5 including:

resilient gasket means interposed between said glass blocks and said frame, respectively, for accommodating differential thermal expansion between said glass blocks and said frame.

10. The panel set forth in claim 5 including:

a guide member depending from a surface of said first plate member for locating said first plate member with respect to said frame.

11. The panel set forth in claim 10 wherein:

said guide member comprises a first web portion secured to a surface of said first plate member and a second depending flange portion for locating said first plate member with respect to said frame.

12. A light transmitting panel for use as at least one of a building exterior wall, roof, floor, and skylight, comprising:

a generally planar first plate member formed of light transmitting glass and forming an outer surface of said panel;

a plurality of glass blocks disposed, generally side by side in a rectangular grid and disposed in supporting relationship to said first plate member; and a frame forming a plurality of receptacles for supporting said glass blocks, respectively, and adapted to be supported on a structural member of a building to form said one of said wall, roof, floor and skylight.

13. The panel set forth in claim 12 including a thermal barrier member disposed at least partially around the periphery of said frame.

14. The panel set forth in claim 12 including:

a guide member connected to said first plate member and operable to position said first plate member laterally with respect to said glass blocks when said first plate member is disposed in supported relationship on said glass blocks, respectively.

15. The panel set forth in claim 12 including:

resilient filler means interposed between adjacent ones of said glass blocks and between said glass blocks and said barrier member.

16. A light transmitting roof portion for enclosing a space within a building comprising:

a plurality of spaced apart beams forming a support;

a plurality of light transmitting panels having a generally rectangular configuration and adapted to be supported on said beams side by side to form a generally planar exterior surface and for transmitting light between the exterior of said building and an interior space, said panels each comprising:

a generally planar rectangular plate assembly formed of light transmitting material;

a perimeter frame adapted to be secured to a bottom side of said plate assembly and supported on said beams;

connector means for securing said frame to said plate assembly; and retainer means for securing said frame to said beams.

17. The invention set forth in claim 16 wherein:

said beams include flange portions supporting said frames on said panels and said retainer means comprise angle members, each including a leg engageable with one of said flange portions and a leg engageable with faster means for securing said angle member to said frame.

18. The invention set forth in claim 16 wherein:

said frame is inset from the peripheral edges of said plate assembly to form a cantilever portion of said plate assembly disposed adjacent a cantilever portion of a plate assembly of an adjacent panel.

19. The invention set forth in claim 16 wherein:

said plate assembly comprises a first plate member formed of a light transmitting glass and being adapted to be exposed to the exterior of said building and a second plate member being formed of a light transmitting material having a thermal conductivity less than the thermal conductivity of said first plate member; and said plate assembly includes means for securing said first plate member to said second plate member.

20. The invention set forth in claim 19 wherein:

said second plate member is plastic.

21. A light transmitting roof portion for enclosing a space within a building comprising:

a plurality of spaced apart beams forming a support;

a plurality of light transmitting panels having a generally rectangular configuration and adapted to be supported on said beams side by side to form a generally planar exterior surface and for transmitting light between the exterior of said building and an interior space, said panels each comprising:

a generally rectangular plate member formed of light transmitting material;

a perimeter frame adapted to be supported on said beams; and a plurality of light transmitting blocks disposed on said frame and in supporting relationship to said plate member.

22. The invention set forth in claim 21 including:

a thermal barrier member disposed about the periphery of said frame.

23. The invention set forth in claim 21 including:

a guide member secured to said plate member for locating said plate member in a predetermined position on said frame.

24. A light transmitting, load bearing roof section for enclosing a space within a building and for providing a surface for supporting at least pedestrian traffic thereon, said roof section comprising:

a plurality of spaced apart beams forming a generally rectangular grid and defining a support for a roof deck;

said roof deck comprising a plurality of light transmitting panels, each of said panels being characterized by a light transmitting plate having opposed side edges, and being supported on said beams in a pattern generally adjacent each other;

seal means interposed between side edges of each of said plates; and each of said panels including a support frame inset from said side edges of said plates, respectively, and supported on said beams, said frame defining an interior space within a perimeter of said frame for transmitting light through said panels between the exterior and interior of said building.

25. The roof section set forth in claim 24 wherein:

said plate comprises a laminated plate assembly having an outer first plate member formed of glass and an inner second plate member formed of plastic having a thermal conductivity lower than said first plate member.

26. The roof section set forth in claim 25 wherein:

said first plate member and said second plate member are secured together by an adhesive.

27. The roof section set forth in claim 25 wherein:

said adhesive is disposed in a peripheral inset ledge formed in one of plate members.

28. The roof section set forth in claim 24 including:

a plurality of glass blocks supported by said frame within said interior space.

29. The roof section set forth in claim 28 including: a thermal barrier member disposed around the exterior of said frame.

30. The roof section set forth in claim 28 including: a guide member disposed on said plate and including a depending portion for locating said plate with respect to said frame.

31. A light transmitting panel for use as one of a building exterior wall, roof, floor and skylight member, comprising:

a generally planar first plate member formed of light transmitting glass and forming an outer surface of said panel;

a second plate member formed of a light transmitting material having a thermal conductivity less than the thermal conductivity of said first plate member:

means for securing said first plate member to said second plate member wherein one of said first plate member and said second plate member includes a peripheral inset forming a ledge for receiving an adhesive for securing said first plate member to said second plate member; and a support frame for said first and second plate members for supporting said first and second plate members on a structural member of a building to form one of said wall, roof, floor and skylight.

32. A light transmitting panel for use as one of a building exterior wall, roof, floor and skylight member, comprising:

a generally planar first plate member formed of light transmitting glass and forming an outer surface of said panel;

a second plate member formed of a light transmitting material having a thermal conductivity less than the thermal conductivity of said first plate member;

means for securing said first plate member to said second plate member; and a support frame for said first and second plate members for supporting said first and second plate members on a structural member of a building to form one of said wall, roof, floor and skylight, said frame comprising a rectangular perimeter member inset from opposite side edges of said first plate member and secured to said second plate member by connector members disposed along at least two sides of said frame.

* * * * *